US009556598B2

(12) United States Patent
Stadtler

(10) Patent No.: US 9,556,598 B2
(45) Date of Patent: Jan. 31, 2017

(54) JET REGULATOR

(75) Inventor: Georg Stadtler, Bad Rodach/Gauerstadt (DE)

(73) Assignee: NEOPERL GMBH, Mullheim (DE)

( * ) Notice: Subject to any disclaimer, the term of this patent is extended or adjusted under 35 U.S.C. 154(b) by 805 days.

(21) Appl. No.: 13/420,017

(22) Filed: Mar. 14, 2012

(65) Prior Publication Data

US 2012/0168534 A1 Jul. 5, 2012

Related U.S. Application Data

(63) Continuation of application No. 12/407,199, filed on Mar. 19, 2009, now abandoned.

(30) Foreign Application Priority Data

Mar. 26, 2008 (DE) ..... 10 2008 015 869

(51) Int. Cl.
*E03C 1/086* (2006.01)
*E03C 1/084* (2006.01)

(52) U.S. Cl.
CPC ..... *E03C 1/086* (2013.01); *E03C 1/084* (2013.01)

(58) Field of Classification Search
CPC ..... E03C 1/08; E03C 1/084; E03C 1/086
USPC ..... 239/428.5, 600
See application file for complete search history.

(56) References Cited

U.S. PATENT DOCUMENTS

| | | | | |
|---|---|---|---|---|
| 2,986,341 | A | 5/1961 | Goodrie | |
| 4,350,298 | A * | 9/1982 | Tada | 239/333 |
| 6,126,093 | A | 10/2000 | Grether et al. | |
| 6,513,731 | B2 | 2/2003 | Griffin et al. | |
| 8,342,431 | B2 | 1/2013 | Stein et al. | |

FOREIGN PATENT DOCUMENTS

| | | | |
|---|---|---|---|
| DE | 3817270 | A1 | 11/1989 |
| DE | 102005048965 | A1 | 4/2007 |
| DE | 102006025301 | | 12/2007 |
| DE | 102007025290 | A1 | 12/2007 |
| WO | 2007137836 | A1 | 12/2007 |

* cited by examiner

*Primary Examiner* — Christopher Kim
(74) *Attorney, Agent, or Firm* — Volpe and Koenig, P.C.

(57) ABSTRACT

A jet regulator, having a non-circular profile when viewed in a flow direction, is provided. The jet regulator includes a jet regulator housing configured to be inserted into a water outlet of a sanitary outlet fitting from an outlet end side. The housing includes a latching part, which has at least one spring arm integrally formed on an outer periphery of the jet regulator housing, the at least one spring arm extending tangentially away from the housing, in the flow direction, toward a free arm end. The at least one spring arm is resiliently biased away from the housing.

3 Claims, 8 Drawing Sheets

JET REGULATOR

CROSS-REFERENCE TO RELATED APPLICATION

This application is a continuation of Ser. No. 12/407,199, filed Mar. 19, 2009, which claims the benefit of German Application DE 10 2008 015 869.0, filed Mar. 26, 2008, the entire contents of all of which are incorporated herein by reference as if fully set forth.

BACKGROUND

The invention relates to a jet regulator which can be inserted with its jet regulator housing into the water outlet of a sanitary outlet fitting from the direction of the outlet end side and which, in the use position, can be releasably fastened or fixed in the water outlet.

It is already known for a jet regulator which is to form a homogenous, non-sputtering water jet to be mounted on the water outlet of a sanitary outlet fitting. Such jet regulators are usually inserted into an outlet mouthpiece which can be detachably screwed to the water outlet of the sanitary outlet fitting.

Since the configuration of the outlet mouthpiece in designing the surface of the sanitary outlet fitting may involve a considerable amount of expenditure, and since the gap remaining between the outlet mouthpiece and the outlet fitting is often perceived as a problem, jet regulators of the type mentioned in the introduction have already been created which can be inserted into the water outlet of a sanitary outlet fitting from the direction of the outlet end side without an additional outlet mouthpiece being necessary for fastening the jet regulator.

The aesthetic demand on the external appearance of sanitary outlet fittings is ever-increasing. For example, outlet fittings have also been created whose water outlet is formed by a tube which is rectangular in cross section. To be able to fix the jet regulator, whose shape is matched in terms of its outline to the rectangular tube cross section, in the water outlet of the previously known outlet fitting, a set screw which serves as a retaining element is provided, which set screw extends through a passage opening provided on the periphery of the fitting housing and engages, with its end region protruding into the housing interior of the fitting housing, on the jet regulator so as to fix the latter. In order that the passage opening and the set screw which is screwed therein do not adversely affect the external appearance of the known outlet fitting, the passage opening is arranged on the flat side, which faces away from the visible side, of the fitting housing.

However, outlet fittings have also already been created in which the visible side of the band-shaped fitting housing forms one of the two narrow sides. Here, a passage opening which is arranged on at least one of the two side surfaces and which is designed for a set screw which extends up to the jet regulator could be objectionable.

SUMMARY

It is therefore the object to create a jet regulator which can be inserted into the water outlet from the direction of the outlet end side and which can be releasably fixed in the water outlet without the required fastening means having an objectionable appearance in any way.

This object is achieved according to the invention with the jet regulator of the type mentioned in the introduction in particular in that the jet regulator can be releasably latched in the water outlet.

The jet regulator according to the invention can be releasably latched in the water outlet. Since the jet regulator according to the invention can be releasably latched in the water outlet of a sanitary outlet fitting, it is possible to dispense with an outlet mouthpiece which can be screwed to the water outlet and which holds the jet regulator. Also, since no rotational movement is required for mounting and dismounting the jet regulator according to the invention, it is possible for the jet regulator housing of the jet regulator according to the invention to have a round cross section or if appropriate also a rectangular cross section. Here, the fastening means required for fastening the jet regulator in the water outlet are not visible from the outside and therefore also cannot have an objectionable appearance.

To create a comfortable, practical and resilient latching connection, it is advantageous if at least one spring arm is integrally formed on the housing outer periphery of the jet regulator housing, which at least one spring arm, in the use position, engages with its free arm end behind an undercut on the inner periphery of the water outlet. The undercut which is required on the inner periphery of the fitting housing can then be provided in a particularly simple manner in particular if the fitting housing is embodied as a comparatively thick-walled cast part, such as will often be the case with a high-grade outlet fitting.

In order that the dismounting of the jet regulator according to the invention is also as simple as possible, it may be advantageous if the free arm end of the at least one spring arm is spaced apart from the housing outer periphery of the jet regulator housing in such a way that a release and/or removal tool can be inserted into the free space between said at least one spring arm and the housing outer periphery. In such an embodiment, the insertion movement of the release and/or removal tool which initiates the dismounting of the jet regulator is facilitated since the release and/or removal tool is guided here between the housing outer periphery of the jet regulator housing on one side and the spring arm on the other side.

It is possible for the at least one spring arm to point with its free arm end counter to the flow direction. It is duly the case in an embodiment of this type that the spring arms are deflected radially inward slightly, and are therefore released from the latching connection, as a result of the insertion of a release and/or removal tool into the free space remaining between the spring arms at the one side and the housing inner periphery of the jet regulator housing at the other side. In contrast, a particularly resilient and nevertheless structurally simple, preferred embodiment provides that the at least one spring arm is aligned in the flow direction of the water jet emerging from the outlet fitting and/or with its free arm end in the outlet direction.

To make it possible for the at least one spring arm which is provided on the jet regulator housing to be deflected radially inward, and released from its latching connection, it is advantageous if the at least one spring arm can, through the use of a pulling movement on the release and/or removal tool which can be applied to the outer side of the spring arm, be acted on with pressure in the outlet direction in such a way that the free arm end which is arranged opposite at the outflow side can be deflected inward. In this embodiment, a pulling movement on the release and/or removal tool is therefore converted into a radial deflecting movement of the at least one spring arm from its use or retaining position into its removal position; here, the removal movement of the jet regulator is additionally assisted by the pulling movement on the release and/or removal tool.

The transmission of the tensile force applied to the jet regulator by the release and/or removal tool and the removal of said jet regulator from the water outlet of the sanitary outlet fitting is additionally promoted if a tool stop is provided at the outside on the free arm section of at least one spring arm, which tool stop interacts with the release and/or removal tool in such a way that a pulling force on the release and/or removal tool can be transmitted to the spring arm and to the jet regulator housing which is connected thereto. Here, it is not strictly necessary for each of the spring arms provided on the housing outer periphery of the jet regulator housing to have a tool stop of said type.

The release and/or removal tool may, with an end section which is for example angled in the shape of a hook, be engaged in a particularly simple manner on the outer side of the spring arm, which is to be deflected for dismounting, if a run-on bevel which tapers counter to the pulling direction is provided, for the release and/or removal tool, upstream of the tool stop at the inflow side on the outside of at least one spring arm. In this embodiment, the release and/or removal tool need therefore merely be inserted into the water outlet beyond the run-on bevel before the release and/or removal tool can then be applied to the outer side of the at least one spring arm by means of the run-on bevel until the spring arm is deflected inward and can be released from its latching connection in the water outlet.

The insertion and retraction movement of the release and/or removal tool is facilitated considerably if at least one molded-out or molded-in portion with at least one axially aligned guide wall is provided on the housing outer periphery of the jet regulator housing, which at least one molded-out or molded-in portion interacts with a counterpart guide surface on the release and/or removal tool.

Here, an embodiment according to the invention which is specified merely by way of example but which is preferable provides that at least one molded-in portion with axially aligned guide walls is provided on the housing outer periphery of the jet regulator housing, which molded-in portion interacts with counterpart guide surfaces provided at both sides on the release and/or removal tool.

It is particularly expedient if at least one spring arm is provided in the region of at least one molded-in portion.

If a plurality of spring elements are provided on the jet regulator housing, the spring elements may also each serve as latching means independently of one another. One particularly resilient design which is simultaneously easy to handle provides that at least two spring arms are connected to one another by means of a tool stop or similar connecting web.

One preferred embodiment according to the invention provides that the at least one spring arm is of L-shaped design and a run-on bevel is provided in the region of the transverse web of the L shape. Here, it is particularly expedient if the L-shaped spring arms are assigned to one another in pairs and are of mirror-symmetrical design with respect to one another.

The features according to the invention may particularly advantageously be used in a jet regulator which has a non-circular, in particular elongate and/or rectangular outline.

BRIEF DESCRIPTION OF THE DRAWINGS

Further features of the invention can be gathered from the following description of the figures in connection with the claims. The invention is described in more detail below on the basis of one advantageous exemplary embodiment. In the figures:

DETAILED DESCRIPTION OF THE PREFERRED EMBODIMENTS

Figure 1:
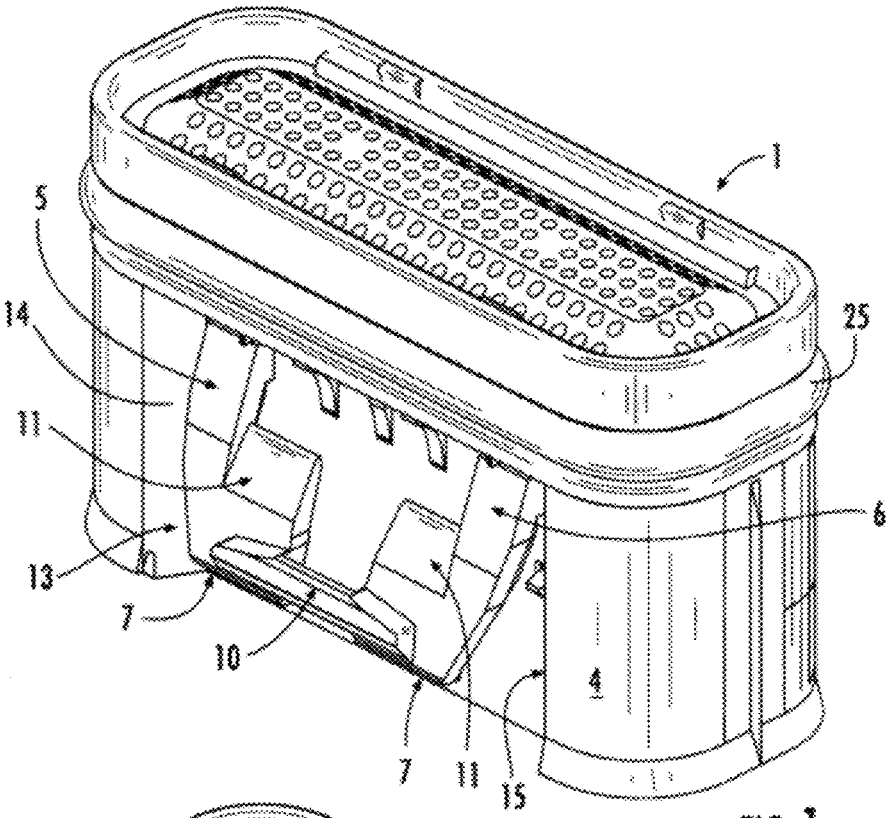
FIG. 1 shows a jet regulator on its inflow side in a perspective view, which jet regulator can be inserted into the water outlet of a sanitary outlet fitting and can be releasably latched there, wherein for this purpose, the jet regulator has, on the outer periphery of its jet regulator housing, two spring arms which are connected to one another and which, with their free arm ends, engage behind an undercut on the inner periphery of the water outlet.
Figure 2:
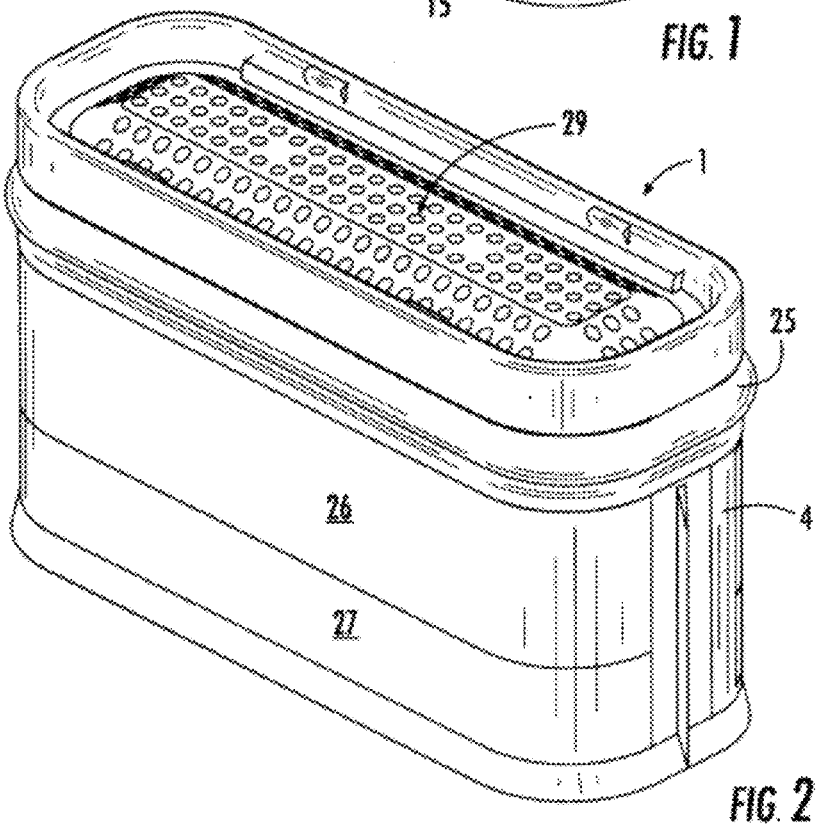
FIG. 2 shows the jet regulator from FIG. 1 on the inflow side in a perspective illustration rotated through 180°.
Figure 3:
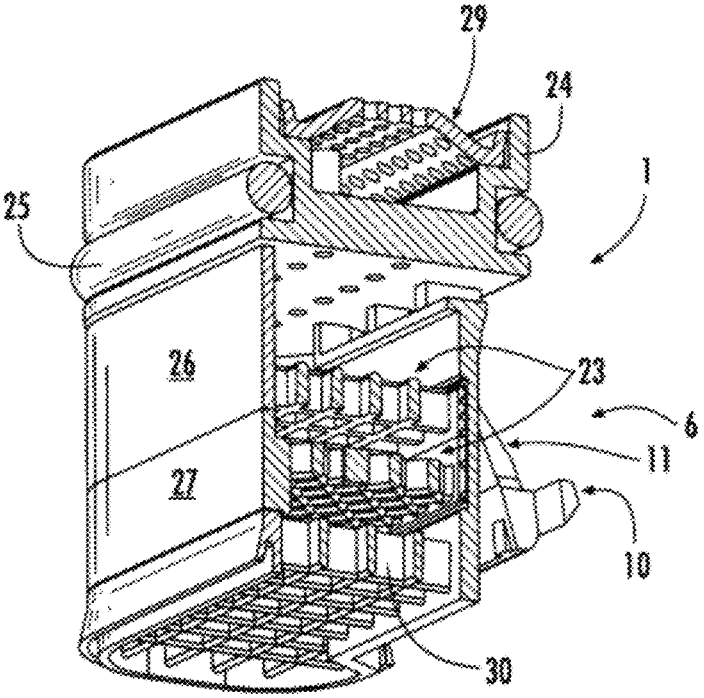
FIG. 3 shows the jet regulator from FIGS. 1 and 2 on the outlet end side in a perspective, longitudinal section view.

FIGS. 1 to 10 illustrate a jet regulator 1 which can be inserted into the water outlet 2 of a sanitary outlet fitting 3 from the direction of the outlet end side, in order to form a homogenous, sparkling, soft and non-sputtering water jet there. To be able to fasten and fix the jet regulator 1 in its use position, the jet regulator 1 can be releasably latched in the water outlet 2. For this purpose, two spring arms 5, 6 are integrally formed on the housing outer periphery of the jet regulator housing 4, which spring arms 5, 6 engage behind a groove-like undercut 8 on the inner periphery of the fitting housing which surrounds the water outlet 2.

The spring arms 5, 6 are aligned in the flow direction of the water jet emerging from the outlet fitting 3 and are arranged with their free arm ends 7 in the outlet direction.

Figures 9, 9A:
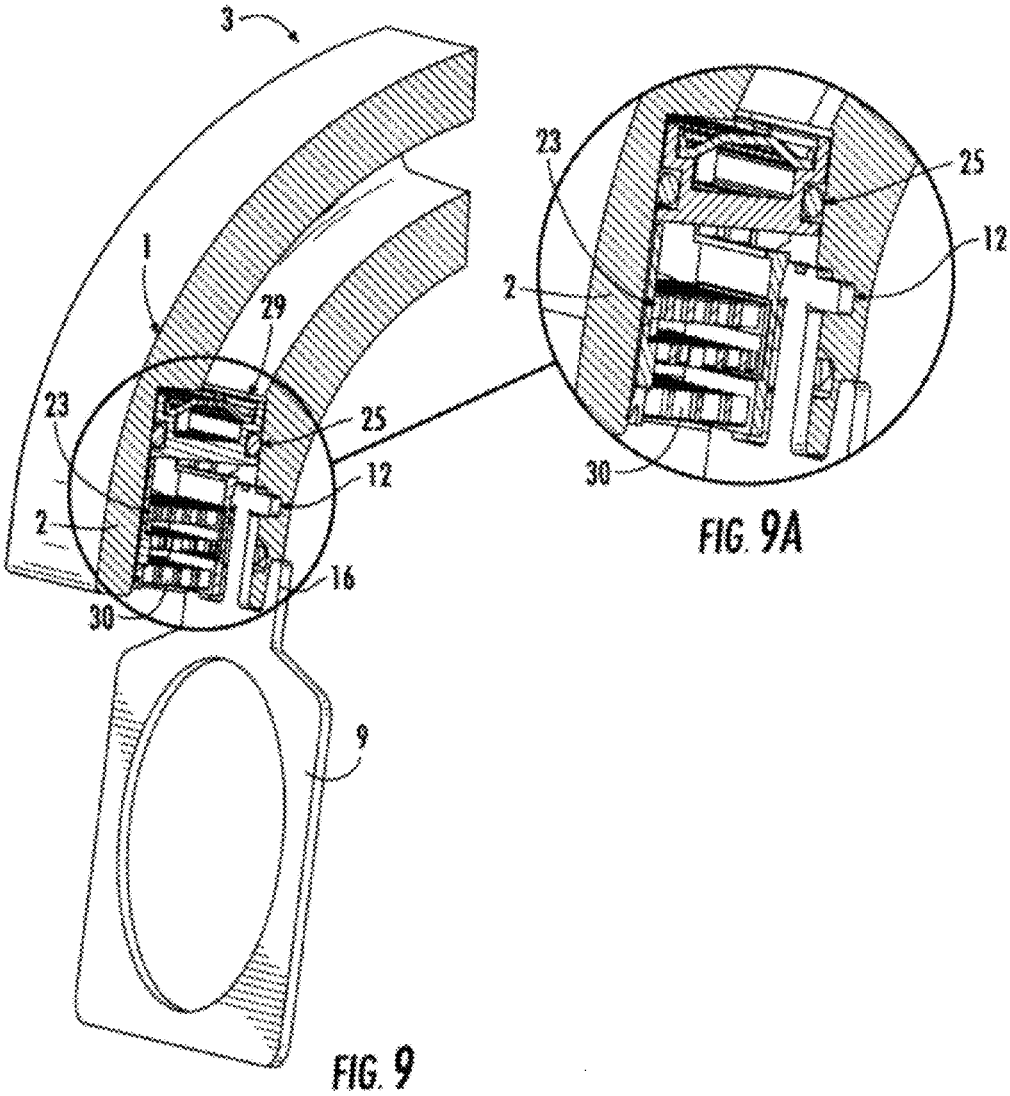
FIG. 9 shows the jet regulator from FIGS. 1 to 8 in a perspective longitudinal section, with a release and/or removal tool applied to the jet regulator.
Figures 10, 10A:
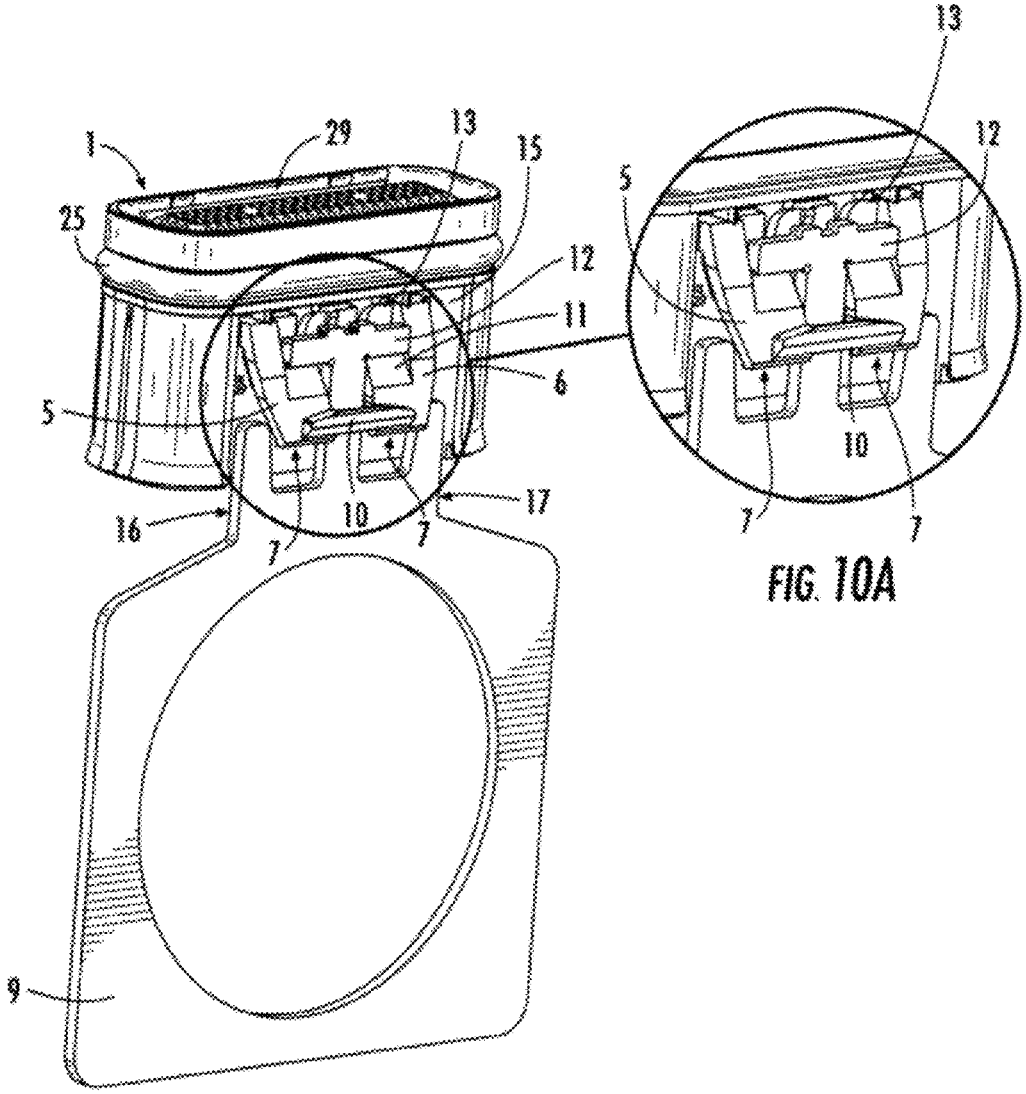
FIG. 10 shows the jet regulator from FIGS. 1 to 9 in a perspective illustration with the release and/or removal tool applied to the jet regulator.
Figure 11:
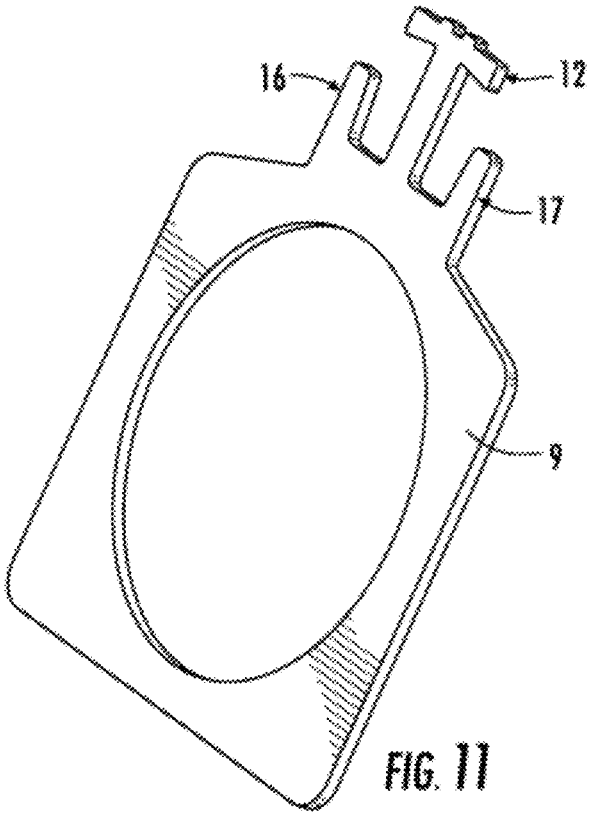
FIG. 11 shows the release and/or removal tool associated with the jet regulator from FIGS. 1 to 10 in a perspective view.
Figure 12:
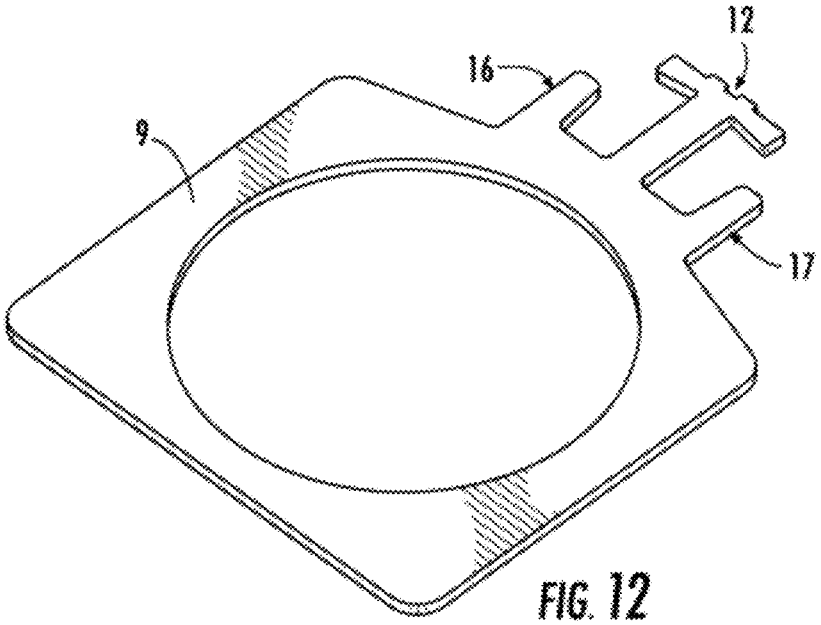
FIG. 12 shows the release and/or removal tool from FIGS. 9 to 11 in a further perspective view.

It is clear from FIGS. 9 and 10 that, for the purpose of dismounting the jet regulator 1 from the water outlet 2, a release and/or removal tool 9 can be applied to the outer side of the spring arms 5, 6 in such a way that the free arm ends 7 of the spring arms 5, 6 can deflected radially inward, and released from their latching connection with the outlet fitting 3, by means of a pulling movement on the release and removal tool 9 in the outlet direction. The spring arms 5, 6 have, on their free arm section 7, a common tool stop 10 which interacts with the release and/or removal tool 9 in such a way that a pulling force on the release and/or removal tool 9 can be transmitted to the spring arms 5, 6 and to the jet regulator housing 4 which is connected thereto.

Figure 4:
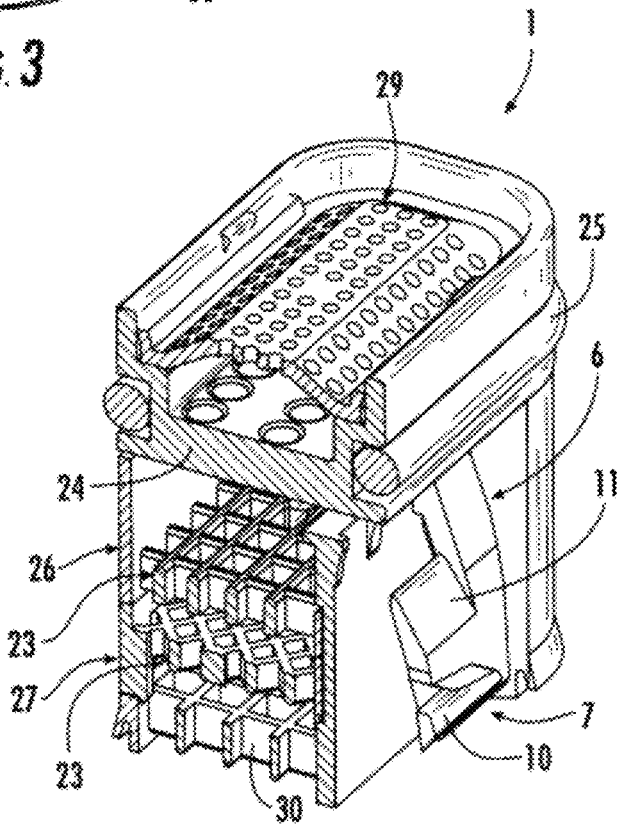
FIG. 4 shows the jet regulator from FIGS. 1 to 3 on the inflow side in a perspective, longitudinal section view.
Figure 5:
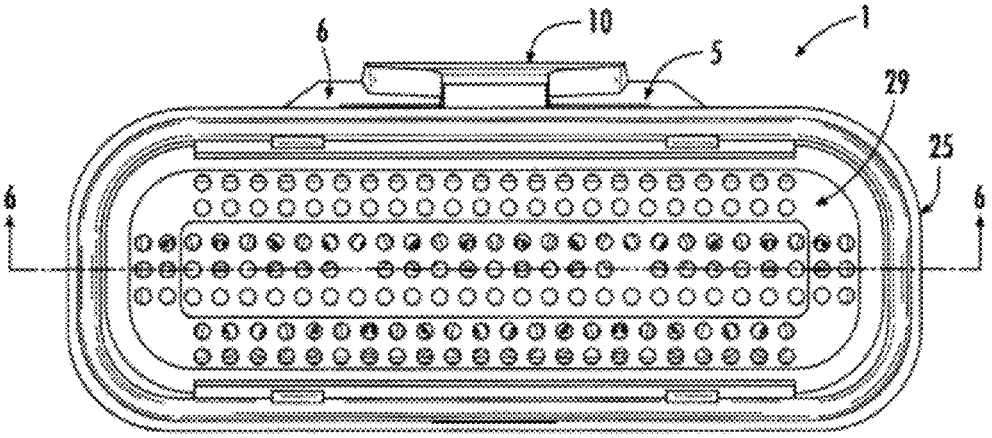
FIG. 5 shows the jet regulator from FIGS. 1 to 4 on its inflow side in a plan view.
Figure 6:
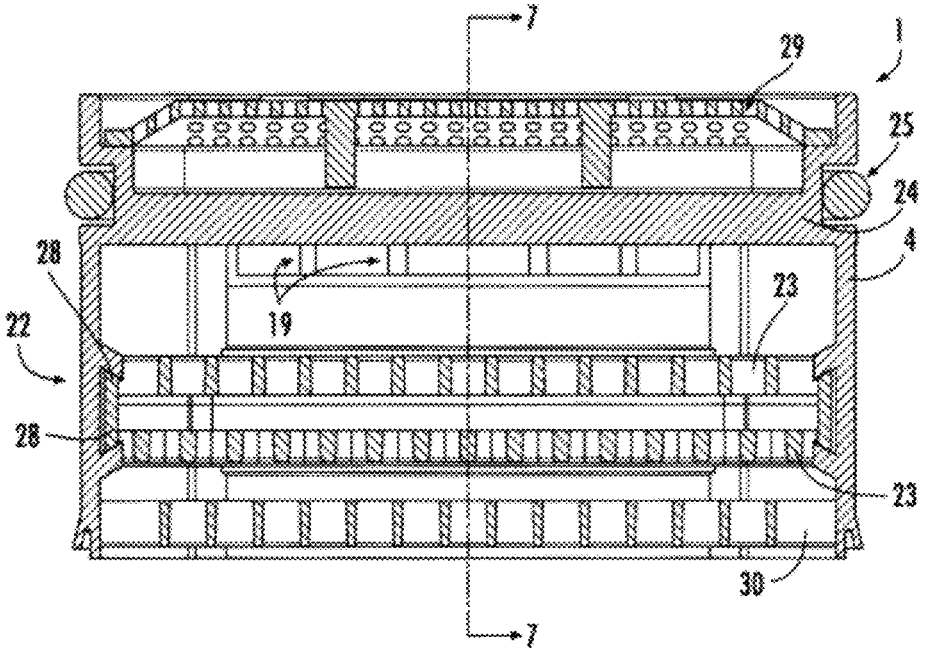
FIG. 6 shows the jet regulator from FIGS. 1 to 5 in a longitudinal section, extending parallel to the longitudinal extent of said jet regulator, through section plane VI-VI in FIG. 5.
Figure 7:
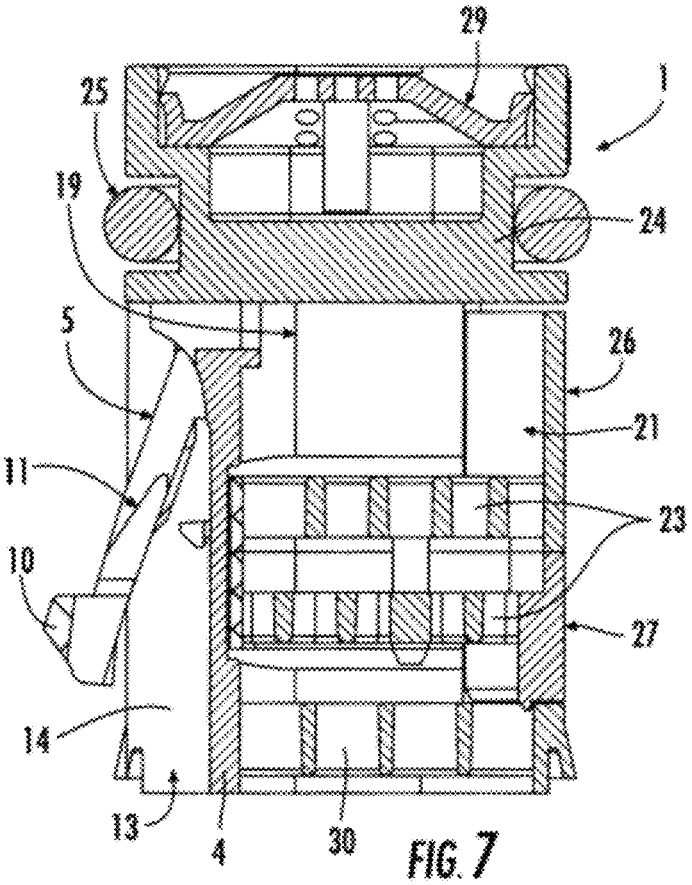
FIG. 7 shows the jet regulator from FIGS. 1 to 6 in a longitudinal section through section plane VII-VII in FIG. 6.
Figures 8, 8A:
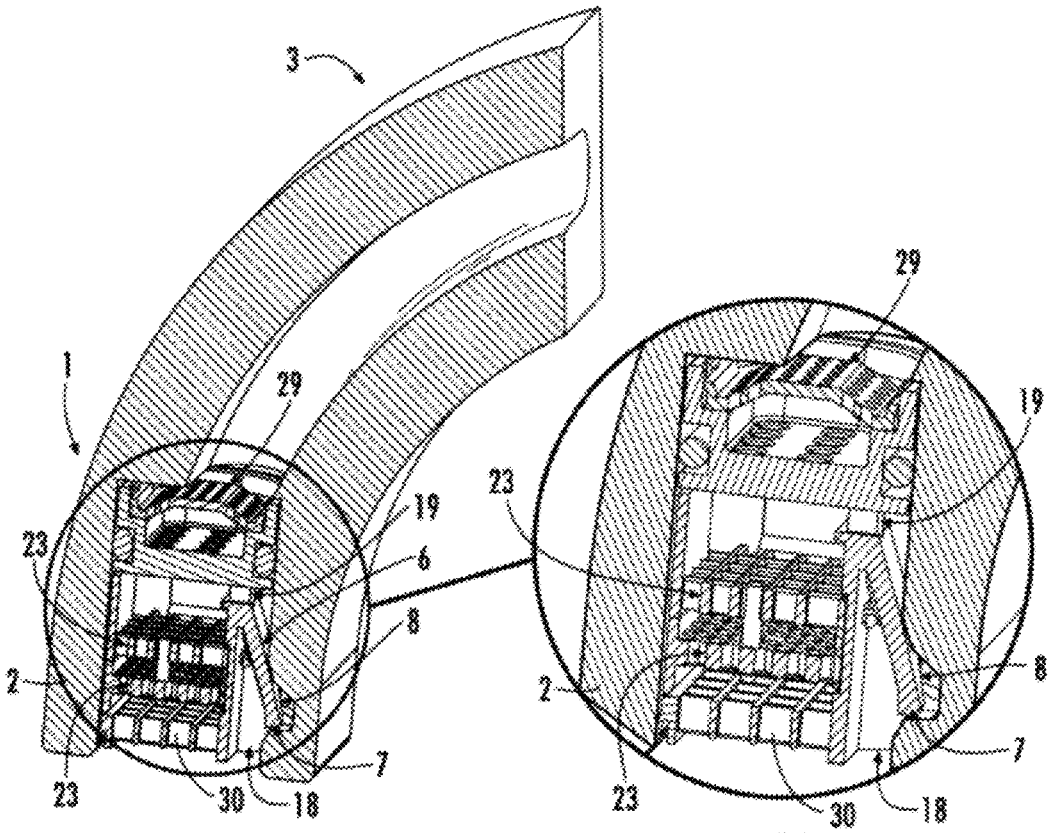
FIG. 8 shows the jet regulator from FIGS. 1 to 7 in its use position, situated in the water outlet of a sanitary outlet fitting, in a perspective longitudinal section.

From a comparison of FIGS. 1, 4 and 7, it is clear that in each case one run-on bevel 11 which tapers counter to the pulling direction is provided, for the release and/or removal tool 9, on the outer sides of the spring arms 5, 6. The release and/or removal tool 9 can therefore be pushed with its T-shaped tool head 12 beyond the run-on bevels 11 into the intermediate space provided between the jet regulator housing 4 and the inner periphery of the fitting housing, before running onto the run-on bevels 11, as a result of a subsequent pulling movement of the T-shaped transverse web of the tool head 12 in the outlet direction, until the spring arms 5, 6 are deflected inward and are released from their latching connection. Here, the T-shaped tool head is pushed through the opening which is bordered between the spring arms 5, 6, the tool stop 10 and the jet regulator housing 4 until the tool head can be pulled along the outside of the spring arms 5, 6 to the tool stop 10.

In FIGS. 1, 4, 7 and 10, it can be seen that the spring arms 5, 6 which are connected by the tool stop 10 are arranged in the region of a molded-in portion 13 which is provided on the outer periphery of the jet regulator housing 4. The molded-in portion 13 has axially aligned guide walls 14, 15 which interact with counterpart guide surfaces 16, 17 provided at both sides on the release and removal tool 9.

FIG. 1 illustrates that the spring arms 5, 6 are formed in an L-shape and have the run-on bevels 11 in the region of the transverse web. Here, the spring arms 5, 6 which are assigned to one another in pairs and which are connected to one another here by means of the common tool stop 10 are of mirror-symmetrical design with respect to one another.

The jet regulator 1 illustrated in FIGS. 1 to 10 is designed as an aerated jet regulator in which air is admixed to the water jet. To be able to draw the air required for admixture into the housing interior of the jet regulator 1, an aeration duct 18 which is open in the direction of the outlet end side of the water outlet 2 is bordered between the molded-in portion 13 on the jet regulator housing 4 and the inner periphery of the outlet fitting 3. The aeration duct 18 opens out in the region of aeration openings 19 which are provided in the jet regulator housing 4. From a comparison of FIGS. 1 to 3, it is clear that the jet regulator 1 has a jet regulator housing 4 with a peripheral push-in opening 21. Here, at least one push-in guide 22 which is aligned transversely with respect to the jet regulator longitudinal axis is provided in the housing interior of the jet regulator housing 4, such that the insert parts 23 required for forming the water jet can be pushed into the push-in guide or push-in guides 22 from the direction of the push-in opening 21. To be able to form the water jet over the entire cross section thereof, the plate-shaped insert parts 23 extend substantially over the entire clear passage cross section of the jet regulator housing 4. It can be seen from FIGS. 3 and 4 and 6 to 9 that the insert parts 23 which serve here as a homogenization device have a jet-forming sieve or grate structure.

A jet diffuser device 24 which is designed as a perforated plate is integrally formed in the jet regulator housing 4 upstream of the push-in opening 21 at the inflow side. To prevent undesired leakage currents between the jet regulator housing 4 on the one hand and the fitting inner periphery on the other hand, an annular seal 25 is provided between the jet regulator 1 and the fitting inner periphery. The annular seal 25 which is supported by the jet regulator housing 4 in the region of the jet diffuser device 24 can bear sealingly against the fitting housing without the risk of a deformation of the jet regulator housing 4 in said region, since the jet diffuser device 24 serves to stiffen the jet regulator housing 4 and counteracts an undesired deformation.

It can be seen from FIGS. 2 to 4 and 7 that the push-in opening 21 of the jet regulator 1 can be closed off by means of a cover which is formed from a plurality of cover partial regions 26, 27 which are integrally formed on the insert parts 23. Pressing projections (not shown in any more detail) can be integrally formed on said cover partial regions 26, 27 at the outside, which pressing projections act on the fitting inner periphery. As the jet regulator 1 is inserted, said pressing projections are clamped between the fitting inner periphery and the jet regulator housing 4 in such a way that the pressing projections press the cover partial regions 26, 27 against the peripheral edge region, which delimits the push-in opening 21, of the jet regulator housing 4 with a sufficient sealing action.

The insert parts 23 can be pushed with lateral guide rails 28 into the push-in openings 22 which are designed at both sides as guide grooves. Here, the guide rails 28 and the guide grooves of the push-in guides 22 form a dovetail-like groove connection.

A sieve or grate structure 30 is integrally formed on the jet regulator housing 4 of the jet regulator 1 at the outlet side, which sieve or grate structure firstly serves as a flow straightener and secondly also constitutes a manipulation prevention device which is intended to prevent unauthorized manipulation of the insert parts 23 situated in the housing interior of the jet regulator housing 4.

It is particularly advantageous if the sieve or grate structures of the insert parts 23 which are positioned in series with one another to be aligned with the gaps of the adjacent structures. Even if the insert parts 23 are of identical design, this is possible by means of a lateral offset of the sieve or grate structures for example by approximately half of a mesh width. Instead, it is also possible to use asymmetrical sieve or grate structures which can be aligned with the gaps of the adjacent structures by means of a simple rotation of the identically-designed insert parts 23.

In each case one ancillary sieve 29 is positioned upstream of the jet regulators 1 at the inflow side, which ancillary sieve 29 filters out the dirt particles contained in the water.

The invention claimed is:

1. A jet regulator (1) comprising a jet regulator housing (4) configured to be inserted into a water outlet (2) of a sanitary outlet fitting (3) from an outlet end side, the housing (4) comprising an outermost perimeter having a generally rectangular profile when viewed in a flow direction and a latching part, which comprises at least one spring arm (5, 6) integrally formed on an outer periphery of the jet regulator housing (4), the at least one spring arm (5, 6) extending away from the housing, in the flow direction, toward a free arm end (7), the at least one spring arm (5, 6) being resiliently biased away from the housing (4).

2. A jet regulator (1) comprising a jet regulator housing (4) configured to be inserted into a water outlet (2) of a sanitary outlet fitting (3) from an outlet end side, the housing (4) comprising an outermost perimeter having a generally rectangular profile when viewed in a flow direction and a molded-in portion (13) provided on an outer periphery of the jet regulator housing (4), the molded-in portion (13) houses a latching part, which comprises two spring arms (5, 6) integrally formed on an outer periphery of the jet regulator housing (4), the spring arms (5, 6) extending away from the housing, in the flow direction, toward a free arm end (7), the spring arms (5, 6) being resiliently biased away from the housing (4).

3. The jet regulator of claim 2, wherein the molded-in portion (13) comprises at least one aeration opening (19) that lead to an interior of the housing (4).

* * * * *